US007195241B1

(12) United States Patent
Hartelius

(10) Patent No.: US 7,195,241 B1
(45) Date of Patent: Mar. 27, 2007

(54) COMBINATION GAME DEVICE AND CANDY DISPENSER

(76) Inventor: Mark E. Hartelius, 8112 Komensky, Chicago, IL (US) 60652

( * ) Notice: Subject to any disclaimer, the term of this patent is extended or adjusted under 35 U.S.C. 154(b) by 0 days.

(21) Appl. No.: 11/431,206

(22) Filed: May 10, 2006

Related U.S. Application Data

(60) Provisional application No. 60/681,316, filed on May 16, 2005.

(51) Int. Cl.
*A63F 7/02* (2006.01)
*A63F 7/36* (2006.01)

(52) U.S. Cl. ..... 273/119 R; 273/118 R; 273/123 R

(58) Field of Classification Search ..... 273/108, 273/118 R, 119 R, 123 R; D21/322, 323, D21/312
See application file for complete search history.

(56) References Cited

U.S. PATENT DOCUMENTS 1,494,963 A * 5/1924 Smith ..... 446/431
D170,948 S * 11/1953 Schigas ..... D21/310
3,224,776 A * 12/1965 Mehelich ..... 273/121 R
D243,780 S * 3/1977 Yamagata ..... D21/323
D247,859 S * 5/1978 Sato ..... D21/312
5,280,908 A * 1/1994 Lu ..... 273/121 R
5,294,172 A * 3/1994 Dubus ..... 297/148
D373,511 S * 9/1996 Militzok ..... D7/589
5,722,656 A * 3/1998 Dickerson ..... 273/118 R
5,988,637 A * 11/1999 Dickerson ..... 273/118 R
6,210,248 B1 * 4/2001 McAdam ..... 446/147
2004/0163990 A1 * 8/2004 Begim ..... 206/472

FOREIGN PATENT DOCUMENTS

GB 2139508 A * 11/1984

* cited by examiner

*Primary Examiner*—Raleigh W. Chiu
(74) *Attorney, Agent, or Firm*—Robert W. J. Usher

(57) ABSTRACT

A combination game device and candy dispenser has a game board defined by an enclosing transparent plastic blister adhered to a support card; a spring powered launcher for candy projectiles; a projectile trap defined by a portion of the blister for receiving launched projectiles; a store of candy pieces and a candy slide formed by a blister portion guiding individual pieces of candy to the launcher. Trapped candy can be accessed through a trap door in the support card. The blister has portions extending adjacent the card surface defining a gate for admitting only a single piece of candy at a time to the launcher and defining a candy store separated from the playing area. The configurations of the game board and trap can be matched to the configuration of an individual candy projectile.

13 Claims, 4 Drawing Sheets

Flip card

1) Break release seal to allow MORE candy into chamber 2) pull back launcher and smack candy upwards
3) once candy is in target area....break perforation and open flap to remove candy. reseal and start again!!!

COMBINATION GAME DEVICE AND CANDY DISPENSER

RELATED APPLICATION

This application claims priority from my provisional application 60/681,316 filed May 16, 2005, the disclosure of which is incorporated herein by reference.

FIELD OF THE INVENTION

The invention relates to mechanical game devices of the type similar to pinball, bagatelle, basketball etc in which a player attempts to launch or flip projectiles across a game board/court into a pocket or trap.

BACKGROUND OF THE INVENTION

It is has been well known for many years to merchandise mechanical devices such as toys in so called "try me" blister packs comprising a blister of transparent plastic adhered around a peripheral edge to a face of a card to enclose the device. In such prior art, a fingerpiece of the device is engageable from outside the package, by a prospective purchaser enabling him to observe the operation of the device, at least to a limited extent, at the point of sale, without removing the device from the blister pack.

However, the packaging itself does not significantly contribute to or provide a structural component of the device which operates independently of the packaging and is normally discarded and therefore wasted after removal of the device for normal use.

SUMMARY OF THE INVENTION

An object of the invention is to provide an game device of the above type in which the structure of the blister pack itself provides a majority, significant or essential part, of the structure and operation of the game device, and remains part of the device throughout normal use.

Such approach simplifies construction enabling extremely economic mass production at high volume. Furthermore, the packaging is not discarded until the game is exhausted eliminating the waste of discarded packaging.

It is another object of the invention to provide a game device of the type above incorporating a candy dispenser, the projectiles consisting of pieces of candy or similar comestibles.

According to one aspect, the invention provides a combination game device and candy dispenser comprising:

a blister pack having a transparent plastic blister providing a cavity and a support card adhered around a peripheral edge of the blister closing the cavity to provide an enclosed game board/court;

a spring powered projectile launcher on the game board/court;

a projectile trap at a location of the game board/court spaced apart from the launcher;

a store of candy pieces on the game board forming individual projectiles and means on the game board/court for guiding individual pieces of candy into registration with the launcher:

the launcher having a finger-piece engagable repeatedly by a player from outside the game board to flex the spring to operate the launcher repeatedly to launch candy pieces successively across the game board/court toward the trap; and means on the game board/court for a player to access trapped candy from outside the game board/court.

It is preferred that the non planar configuration of the game board/court is provided by molding portions of the blister obviating a requirement for additional components and affording extremely economic manufacture.

Preferably, the projectile trap comprises a portion of the blister molded into a channel section shape extending axially inwardly to a surface portion of the card providing a candy holding pocket.

It is also preferred that the blister has a portion formed to provide a compartment on the game board/court anchoring the spring on the game board/court retained by walls of the compartment and the surface of the card.

Desirably, the means on the game board/court for a player to access trapped candy from outside the game board/court comprises a line of weakness, such as perforations, provided in the card, defining a card portion which is removable/releasable by tearing along the line of weakness, to provide access to the trap to permit removal of the candy therefrom.

Preferably, the line of weakness defines a flap pivotable away from and towards a back of the card to open and close the trap, respectively, to release and confine candy.

Preferably, the finger piece protrudes out of the cavity through a slot provided in the blister.

The means on the game board/court for guiding individual pieces of candy into registration with the launcher is comprised by a portion of the blister which extends towards the card, and is preferably an elongate portion of a peripheral edge of the blister which inclines towards the launcher providing a candy slide.

Another portion of the blister extends towards the card at a location adjacent and spaced apart from a surface of the candy slide defining therewith a gate for admitting only individual candy pieces of the store successively into registration with the launcher.

Thus, only three separate pieces are needed to make the combined game device and candy dispenser: a plastic blister, a support card and a launcher.

In a modification engagement of the blister with the card provides a boundary wall of a candy storing compartment separated from the playing area by a door which is manually openable from outside the blister to release any desired numbers of candy pieces into the playing area in general registration with the launcher.

According to another aspect, the invention provides a game device of the type above in which substantially the entire boundary of a game board/court or playing area is defined by the points of attachment of peripheral edge portions of a transparent plastic blister to a support card which closes the blister cavity. This also enables the configuration of the boundary of the playing area and that of the trap or pocket to be matched to that of the candy projectiles, providing another aspect of the invention.

BRIEF DESCRIPTION OF THE DRAWINGS

In order that the invention may be readily understood, specific embodiments thereof will now be described by way of example only and with reference to the accompanying drawings in which.

DESCRIPTION OF PARTICULAR EMBODIMENTS

Figure 1:
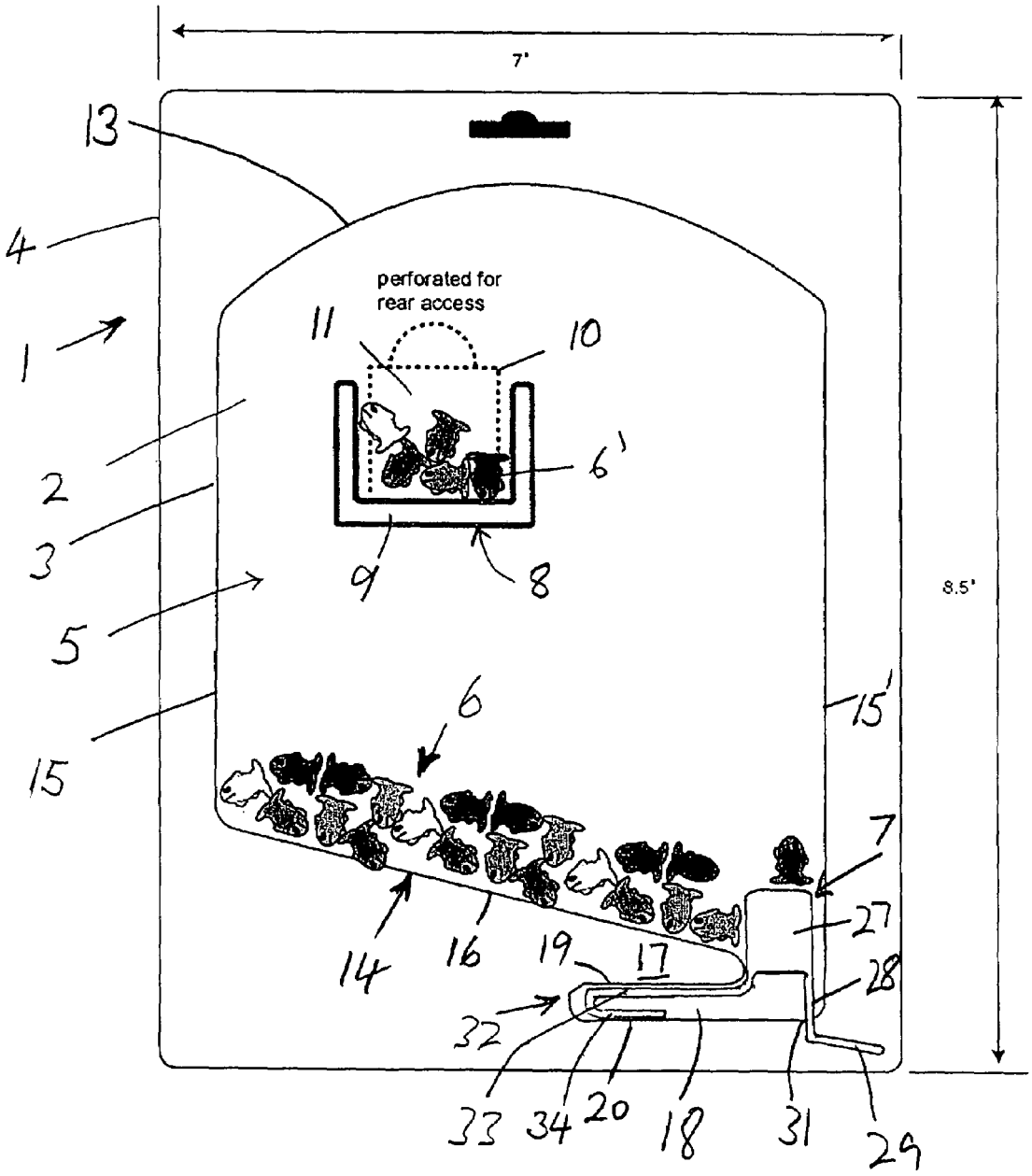
FIG. 1 is a schematic front view of a first embodiment of party flip game according to the invention.
Figure 2:
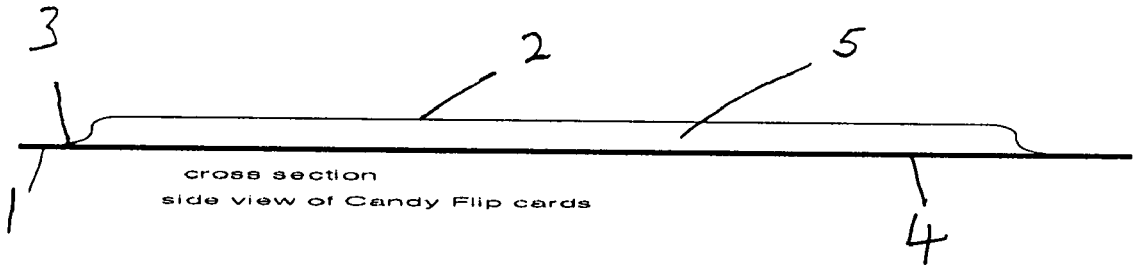
FIG. 2 is a diagrammatic side view of the first embodiment.

As shown in FIGS. 1 and 2, a first embodiment of combined game device and candy dispenser comprises a blister pack 1 having a transparent plastic (PETE) blister 2 providing a cavity and adhered around a peripheral edge 3 to a support card 4 closing the cavity to provide an enclosed game board/court or playing area 5. A store of candy pieces 6 are contained in the playing area 5. A candy launcher or flipper 7 is mounted at a lower right corner of the playing area 5 and a candy trap formed as a pocket 8 is provided at an upper left location of the playing area.

The candy trap/pocket comprises a portion of the blister molded into a double-walled channel section/U shape 9 extending axially inwardly to a front surface portion of the card 4 to which it is adhered, providing a candy holding pocket open at a top. The front surface of the card closes the rear of the pocket and a line of weakness formed by a series of perforations 10 are provided in the card, which when broken define a pocket closing flap 11 pivotable rearwards to open the pocket and permit removal of the candy therefrom. The flap 11 can be repeatedly pulled open by the player's fingers and pushed back to rest, albeit somewhat imprecisely, in the pocket closing position.

The game board/court or playing area 5 has a perimeter bounded by a top wall 13 curved to guide (return) flipped candy towards the pocket; a lower wall 14; and opposite, left and right side walls 15 and 15', respectively, extending between the top and lower walls, 13 and 14.

The lower wall 14 is inclined downwards for a majority of its length as it extends away from the left side wall 15 towards the right side wall 15' providing a candy slide for guiding candy in the store 6 into registration with the launcher 7; turns back forming a leftward extending wall portion 19 at a location adjacent and spaced from the right side wall to define with the right side wall 15' a launcher head receiving gap; then returns to extend leftwards and rightwards forming upper wall portion 18 and a lower wall portion 19, separated from the right side wall by a small slot 31. The wall portions 19 and 20 provide opposite sides of an anchoring cavity/compartment 18 for the launcher, as further described below.

The launcher or flipper 7 is molded in one piece of plastic and comprises an impact head 27 from a lower right side of which an arm portion 27 depends vertically and extends out of the playing area through a slot 31 in the blister and terminates in a cranked finger-piece 29. A hairpin spring 32 extends leftward from a lower left side of the launcher body into the cavity 18 and has upper and lower arms 33 and 34 engaging upper and lower cavity wall portions 19 and 20, respectively, anchoring the spring in the cavity.

It will be readily appreciated that repeated manual depression and release of the finger-piece reciprocates the launcher head vertically in the gap to flip candy pieces which successively slide into registration with the head, across the game board in the general direction of the trap where some will be captured and can be accessed by the player by release of the closure flap.

Figure 3:
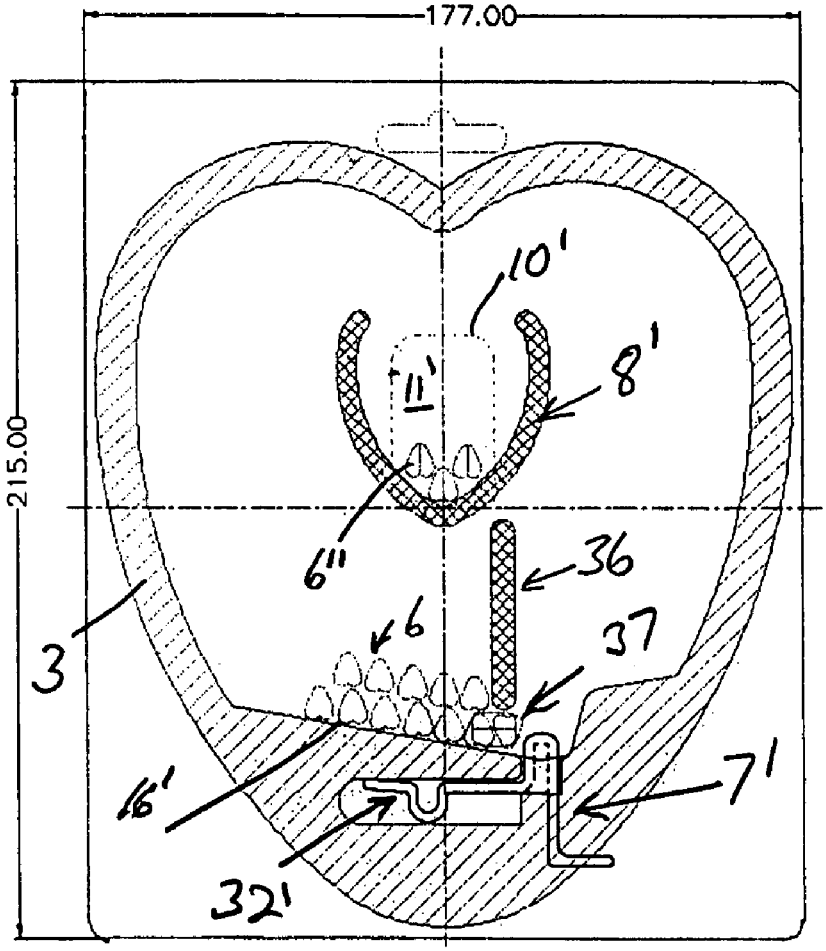
FIG. 3 is a front view of a second embodiment.
Figure 4:
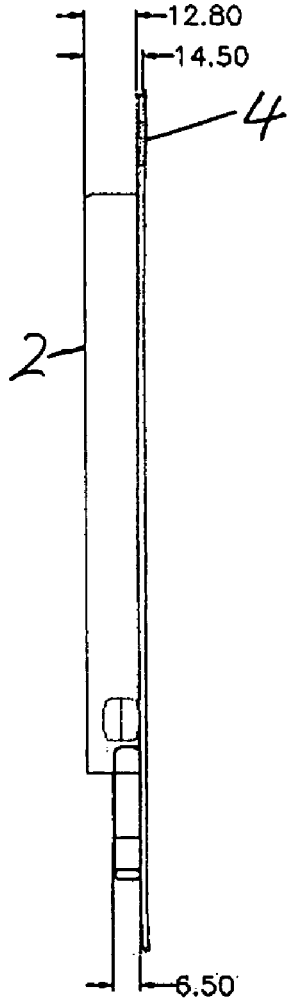
FIG. 4 is a diagrammatic side view of the second embodiment.

As the second embodiment shown in FIGS. 3 and 4, is similar in most respects to the first embodiment, primed reference numerals have been used to indicate similar parts.

In this embodiment, the perimeter of the playing area as defined by the adherence of the edges of the blister 3 to the support card and the candy trap or pocket 8' define a heart shape motive to match the heart shape of the candy. The spring 32' of the launcher 7' is a single arm cantilever type instead of a hairpin and a portion of the blister 36 extends towards and adheres to the card front at a location adjacent and spaced apart from a surface of the candy slide 6' defining therewith a gate 37 for admitting only individual candy pieces of the store successively into registration with the launcher 7'.

Figure 5:
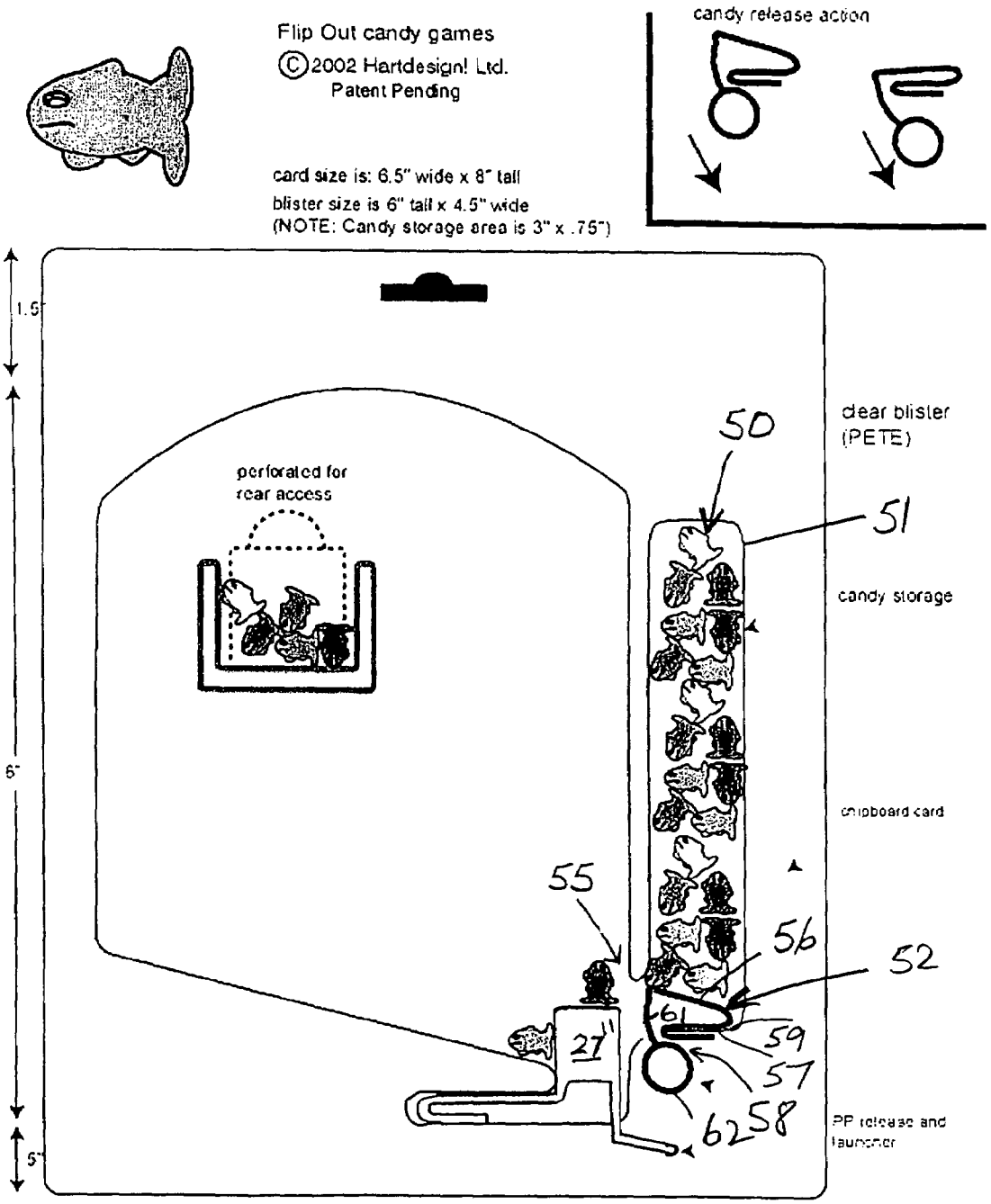
FIG. 5 is a diagrammatic front view of a third embodiment with a separate candy storing compartment from which candy pieces can be released into play as desired.

In a third embodiment shown schematically in FIG. 5, instead of permitting all the candy to be stored on the slide in the playing area, the candy 50 is stored in a compartment 51 separated from the playing area by a door 52 which can be opened and closed by the player to control the number of candy pieces admitted into the player area at any time.

The boundary of the compartment 51 is defined by portions of the blister adhering to the card (chipboard) and extends vertically along right side wall portion 15" having an opening 55 at the bottom left to the playing area, adjacent and above the impact head 27" of the launcher. The door 52 comprises a hairpin spring having one limb 56 normally extending across the bottom of the compartment 51 blocking the opening 55 into the playing area and the other limb 57 reversely bent to extend through a slot 58 in the blister wall and capture the blister wall portion 59 adjacent the slot. An actuating arm 61 depends from a free end of the limb 56 and also extends out of the blister through the slot 58 and is terminated at a lower end by a pull ring 62 enabling spring limb 56 to be flexed to open the door to release a desired number of candy pieces into the playing area. The launcher and door may be formed from respective bent metal strips instead of one-piece molded plastic moldings.

The invention claimed is:

1. A combination game device and candy dispenser comprising:

a blister pack having a transparent plastic blister providing a cavity and a support card adhered around a peripheral edge of the blister closing the cavity to provide an enclosed game board/court;

a spring powered projectile launcher on the game board/court;

a projectile trap at a location of the game board/court spaced apart from the launcher;

a store of candy pieces on the game board forming individual projectiles and means on the game board/court for guiding individual pieces of candy into registration with the launcher:

the launcher having a finger-piece engagable repeatedly by a player from outside the game board to flex the spring to operate the launcher repeatedly to launch candy pieces successively across the game board/court toward the trap; and means on the game board/court for a player to access trapped candy from outside the game board/court.

2. The combination of claim 1, wherein a non planar configuration of the game board/court is provided by molded portions of the blister.

3. The combination of claim 1, wherein the projectile trap comprises a portion of the blister molded into a channel section shape extending axially inwardly to a surface portion of the card, providing a candy holding pocket.

4. The combination of claim 1, wherein the blister has a portion providing at least part of a compartment anchoring the spring on the game board/court retained by walls of the compartment and the surface of the card.

5. The combination of claim 1, wherein the means on the game board/court for a player to access trapped candy from outside the game board/court comprises a line of weakness provided in the card, defining a card portion which is one of removable and releasable by tearing along the line of weakness, to provide access to the trap to permit removal of the candy therefrom.

6. The combination of claim 5, wherein the line of weakness defines a flap pivotable away from and towards a back of the card to open and close the trap, respectively, to release and confine candy.

7. The combination of claim 1, wherein the finger piece protrudes out of the cavity through a slot provided in the blister.

8. The combination of claim 1, wherein the means on the game board/court for guiding individual pieces of candy into registration with the launcher is comprised by a portion of the blister which extends towards the card.

9. The combination of claim 1, wherein the means on the game board/court for guiding individual pieces of candy into registration with the launcher is an elongate portion of a peripheral edge of the blister which inclines towards the launcher, providing a candy slide.

10. The combination of claim 9, wherein another portion of the blister extends towards the card at a location adjacent and spaced apart from a surface of the candy slide defining therewith a gate for admitting only individual candy pieces of the store successively into registration with the launcher.

11. The combination of claim 1, wherein a portion of the blister which engages the card provides a boundary wall defining a candy storing compartment separated from the playing area by a door which is manually openable from outside the blister to release any desired numbers of candy pieces into the playing area in general registration with the launcher.

12. The combination of claim 11, wherein the door comprises a hairpin spring having one limb normally extending across a bottom of the compartment blocking the opening into the playing area and another other limb reversely bent to extend through a slot formed in the blister wall and captures a portion of the blister wall which is adjacent the slot; an actuating arm depends from a free end of the limb and also extends out of the blister through the slot and is terminated at a lower end by a fingerpiece comprising one of a hook and eye enabling a limb of the spring to be flexed to open the door to release a desired number of candy pieces into the playing area.

13. The combination of claim 1, wherein an entire boundary of the game board/court is defined by points of attachment of peripheral edge portions of a transparent plastic blister to the support card which closes the blister cavity and a configuration of the boundary of the playing area and that of the trap or pocket is matched to a configuration of the candy projectiles.

* * * * *